US007431237B1

(12) United States Patent
Mock et al.

(10) Patent No.: US 7,431,237 B1
(45) Date of Patent: Oct. 7, 2008

(54) GUIDED PROJECTILE WITH POWER AND CONTROL MECHANISM

(75) Inventors: M. Robert Mock, Moorpark, CA (US); John Adams Marshall, Newhall, CA (US); Grant Allen Sweer, Santa Clarita, CA (US)

(73) Assignee: HR Textron, Inc., Santa Clarita, CA (US)

( * ) Notice: Subject to any disclaimer, the term of this patent is extended or adjusted under 35 U.S.C. 154(b) by 78 days.

(21) Appl. No.: 11/502,018

(22) Filed: Aug. 10, 2006

(51) Int. Cl.

| | |
|---|---|
| ***F41G 9/00*** | (2006.01) |
| ***H02K 21/00*** | (2006.01) |
| ***F42B 15/01*** | (2006.01) |
| *F41G 7/00* | (2006.01) |
| *F42B 15/00* | (2006.01) |

(52) U.S. Cl. ..... 244/3.24; 244/3.1; 102/473; 102/501; 102/200; 102/206; 102/207

(58) Field of Classification Search ..... 244/3.1–3.3; 102/501–529, 206–209, 200, 473; 310/40 R, 310/152, 156.01, 156.08, 156.16, 77
See application file for complete search history.

(56) References Cited

U.S. PATENT DOCUMENTS

| | | | | |
|---|---|---|---|---|
| 3,611,943 | A * | 10/1971 | Popper | 102/208 |
| 3,747,529 | A * | 7/1973 | Plattner | 102/209 |
| 3,826,193 | A * | 7/1974 | Rognmo et al. | 102/208 |
| 3,994,228 | A * | 11/1976 | Hurlimann | 102/209 |
| 4,004,519 | A * | 1/1977 | Hopkins | 102/208 |
| 4,088,076 | A * | 5/1978 | Karayannis | 102/209 |
| 4,142,696 | A * | 3/1979 | Nottingham | 244/3.16 |
| 4,248,153 | A * | 2/1981 | Sjotun et al. | 102/208 |
| 4,577,116 | A * | 3/1986 | Pinson | 310/156.16 |
| 4,665,332 | A * | 5/1987 | Meir | 310/77 |
| 4,898,342 | A * | 2/1990 | Kranz et al. | 244/3.21 |
| 4,964,593 | A * | 10/1990 | Kranz | 244/3.24 |
| 5,115,742 | A * | 5/1992 | Frazer | 102/208 |
| 5,452,864 | A | 9/1995 | Alford et al. | 244/3.23 |
| 6,845,714 | B1 * | 1/2005 | Smith et al. | 102/208 |
| 7,095,193 | B2 | 8/2006 | Kellogg et al. | |
| 7,109,679 | B2 | 9/2006 | Edson et al. | |
| 7,116,100 | B1 | 10/2006 | Mock et al. | |

* cited by examiner

*Primary Examiner*—Bernarr E Gregory
(74) *Attorney, Agent, or Firm*—BainwoodHuang

(57) ABSTRACT

A projectile has the ability to generate and provide power to components located in two sections of the projectile which have relative rotation to each other. The projectile has a pair of generators allowing the powering of components in two sections. The projectile has a force-producing device for altering the direction of the projectile as the projectile moves along the longitudinal axis of the projectile and the relative rotational position of the force-producing device on the projectile is controlled by a generator.

23 Claims, 11 Drawing Sheets

GUIDED PROJECTILE WITH POWER AND CONTROL MECHANISM

BACKGROUND

There are various ways to deliver an explosive device to a target. These methods include using various vehicles including guided missiles, guided or smart artillery shells, and dumb artillery shells. There are benefits and detriments to each type of device.

The guided missiles are very accurate and include an internal propulsion system. However, the cost per vehicle, missile, is very expensive. Guided or smart artillery shells are not as expensive per item. However, the shell does not have its own propulsion method.

Guided or smart artillery have a force-producing device to maneuver the projectile during the flight. Electronics in the projectile determine the position of the projectile. The electronics are powered by the batteries located within the projectile. The batteries add cost to the artillery. In addition, the batteries add weight to the projectile thereby reducing the capacity of other components including electronics and/or explosive charges. While the guided artillery shell has a force-producing device, the artillery shell does not include a propulsion system. The added weight of the batteries also reduces the range of the artillery shell.

Dumb artillery shells are significantly cheaper per shell than the guided missiles and cheaper than the guided or smart artillery. However, when firing dumb artillery shells, the first shells tend to miss their target with a wide dispersion. This delivery process is successful through a trial and correction process to correct for conditions including environment.

SUMMARY

It is recognized that an artillery shell or a projectile receives stability from the spin placed on the shell as it is launched. Unfortunately, there are deficiencies to the above-described projectiles. The projectiles are either very expensive per projectile such as in a guided missile or are inaccurate as in a dumb artillery shell. In conventional guided or smart artillery shells, the battery requirement adds cost and limits performance. In addition in most conventional projectiles, the projectile spins as one unit; in cases where the projectile has two sections spinning at two different rates, the components and sensors are both located in one of the sections.

In contrast to the conventional projectiles, embodiments of the invention are directed to techniques for generating and providing power to components located in two sections of the projectile which have relative rotation to each other. It is recognized that at least some of the components related to guidance should not rotate or rotate minimally in relation to the terrain over which the projectile flies on a smart or guided artillery shell or projectile.

In addition, the projectile has a force-producing device for altering the direction of the projectile as the projectile moves along the longitudinal axis of the projectile and that relative rotational position of the force-producing device on the projectile is controlled by a generator. The projectile can be guided to the target efficiently and cost effectively. Accordingly, the conventional approach of projectiles of limiting sensors and other components to certain sections or requiring batteries is unnecessary.

In one arrangement, the projectile has an elongated shell and a guidance and control assembly. The guidance and control assembly has a cone front and is mounted to the front of the shell. The shell has a charge. The guidance and control assembly has a front section and a rear section. The sections are rotatably mounted to each other. The rear section of the guidance and control assembly is secured to the shell and has a detonator. The front section of the guidance and control assembly has an aerodynamic device for influencing the relative rotation of the front section of the guidance and control assembly relative to the rear section and the shell.

The projectile has a first generator having an armature and a field. The field is carried by one of the sections of the guidance and control assembly. The armature is carried by the other section. A second generator of the projectile has an armature and a field. The field is carried by the section carrying the armature of the first generator and the armature is carried by the section carrying the field of the first generator. One of the generators scavenges power from the relative rotation of the front and rear sections to power at least one electrical component located in the front section of the guidance and control assembly. The other generator scavenges power from the relative rotation of the front and rear sections to power at least one electrical component located in the rear section of the guidance and control assembly and in the shell.

In one arrangement, the armature of the first generator is carried by the front section of the guidance and control assembly and the field of the first generator is carried by the rear section of the guidance and control assembly. The armature of the second generator is carried by the rear section of the guidance and control assembly and the field is carried by the front section of the guidance and control assembly. The first generator scavenges power from relative rotation to power at least one component located in the front section of the guidance and control assembly. The second generator scavenges power to power at least one component located in the rear section of the guidance and control assembly and in the shell.

In an arrangement, the field of the first generator is produced by an array of permanent magnets and the field of the second generator is produced by an electromagnet. The field of the second generator is produced by a current originating from the first generator to the electromagnet.

In an arrangement, the armature and the field of the second generator each have a planar surface with a plurality of arc sections. Each section has a series of conductive traces formed into a spiral pattern forming a segment winding. A signal is communicated from the front section of the guidance and control assembly to the rear section of the guidance and control assembly through an armature field interface of the second generator by a high frequency signal.

In another arrangement, the armature of the first generator is carried by the rear section of the guidance and control assembly. The field of the first generator is carried by the front section of the guidance and control assembly. The armature of the second generator is carried by the front section of the guidance and control assembly. The field is carried by the rear section of the guidance and control assembly. The first generator scavenges power from relative rotation to power at least one component located in the rear section of the guidance and control assembly and the shell. The second generator scavenges power to power at least one component located in the front section of the guidance and control assembly.

In an arrangement, one of the generators reduces rotation of the front section relative to the rear section by drawing current from the armature. The generator reduces the relative rotation of the front section to the rear section by electromagnetic braking.

In an arrangement, the front section's relative position related to the rear section of the guidance and control assembly and the shell is controlled by a controller varying the current drawn from one of the generators. A force-producing device exerts a force that is not parallel and substantially perpendicular to the longitudinal axis of the projectile. The force-producing device is carried by the front section of the guidance and control assembly.

In an arrangement, the aerodynamic device is a plurality of strakes for inducing a relative rotation of the front section counter to the rotation of the rear section.

In an arrangement, there is a communication linking mechanism for communication between components in the front section with components in the rear section and in the shell. In one arrangement, the communication linking mechanism is an optical link. In another arrangement, the communication linking mechanism is a high frequency signal carried over a field/armature interface.

In an arrangement, the first and the second generators are co-axial about the longitudinal axis of the projectile. In an arrangement, a controller directs energy from the generator to alternative devices including a recharge storage device and an excess energy dissipating device. The controller for the generator is responses to commands to vary the current resulting in varying the torque, to achieve the proper orientation of the force-producing device.

A method of targeting a projectile to hit a target includes firing the projectile from a gun. A rotation of the projectile along a longitudinal axis of the projectile is created due to the rifling of the gun barrel. The front section of the guidance and control assembly of the projectile is rotated relative to a rear section of the guidance and control assembly and a shell of the projectile by a plurality of aerodynamic devices carried by the front section interacting with the air as the projectile moves through the air. A pair of generators in the guidance and control assembly create power in the projectile by each generator having a field and armature and the field of one of the generators and the armature of the other generator carried by the front section and the armature of the one of the generators and the field of the other generator carried by the rear section. At least one component in each of the sections of the guidance and control assembly is powered from the respective generator.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

An improved projectile has the ability to generate and provide power to components located in two sections of the projectile where the two sections have rotation relative to each other. In addition, the projectile has a force-producing device for altering the direction of the projectile as the projectile moves along the longitudinal axis of the projectile and that relative rotational position of the force-producing device on the projectile is controlled by a generator. The projectile can be guided to the target efficiently and can be manufactured cost effectively. Accordingly, the conventional approach of a projectile limiting control components such as sensors and control electronics, including GPS, fuse, and power control devices, to certain sections or requiring batteries is unnecessary.

Figure 1:
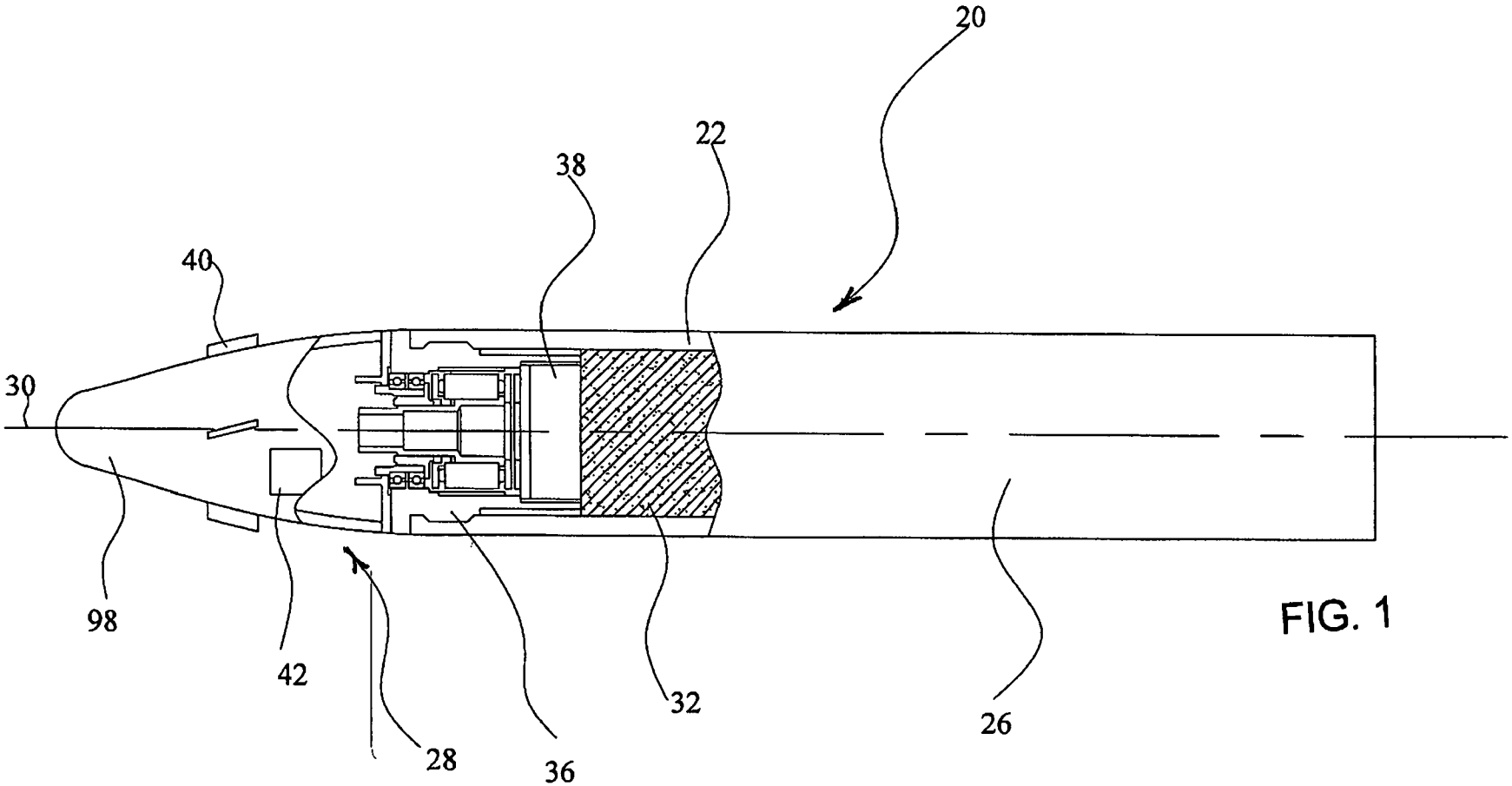
FIG. 1 is a side elevation partial cutaway view of a projectile.

FIG. 1 shows a projectile 20 with a portion of an outer casing 22 broken away to show a portion of the interior of the projectile 20. The projectile 20 has a shell 26 and a guidance and control assembly 28. The guidance and control assembly 28 is located in front, to the left in FIG. 1, of the shell 26 along the longitudinal axis 30 of the projectile 20. The shell 26 has an outer casing 22 and an explosive charge 32, shown in section in FIG. 1.

The guidance and control assembly 28 has a front section 34 and a rear section 36. The rear section 36 is mounted to the outer casing 22 of the shell 26. The two sections 34 and 36 of the guidance and control assembly 28 are rotatably mounted to each other to allow relative rotation about the longitudinal axis 30 of the projectile 20. The interface between the two sections 34 and 36 will be described in greater detail below with respect to FIG. 4.

The rear section 36 of the guidance and control assembly 28 has a detonator 38 portion of the fuse which detonates the explosive charge 32 in the projectile 20 when activated.

The front section 34 of the guidance and control assembly 28 has an aerodynamic device such as a plurality of strakes 40 that interact with the flow of air as the projectile 20 moves through the air to influence a rotation on the front section 34 of the guidance and control assembly 28. The projectile 20 has a force-producing device 42 located on the front section 34; the force-producing device 42 assists in controlling the motion of the projectile 20 through the air.

Figure 2:
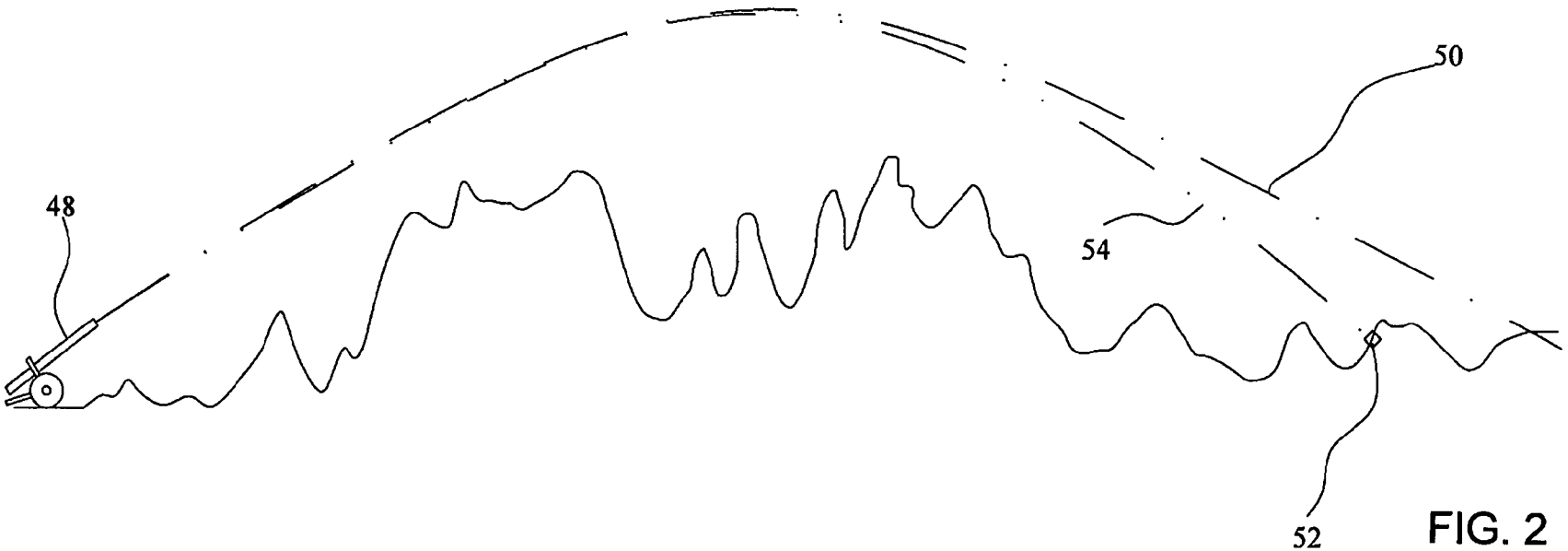
FIG. 2 is an illustration of the flight of the projectile.

Referring to FIG. 2, a schematic of the flight path of a projectile 20 is shown. The projectile 20 is launched from a cannon 48. The cannon 48 has rifling in its barrel. The rifling imparts a spin on the projectile 20 as the projectile 20 leaves the barrel of the cannon 48 at a very high velocity due to the high acceleration imparted on the projectile 20. The spin imparted on the projectile 20 allows the projectile 20 to travel in a more stable flight path. In conventional projectiles, the projectile is not controlled after it leaves the cannon 20. Such a flight path is represented by line 50. Due to several factors including weather conditions such as wind and humidity, the exact location where the projectile is going to land is difficult to determine. It is therefore common for projectiles to miss their target 52 with a wide dispersion and typically only successfully hit the target through a process of trial and correction.

The projectile 20 of the arrangements described below is capable of maneuvering during flight to improve the success rate of hitting the target. The projectile 20 does not have a propulsion system. As is described below, the projectile 20 can be controlled to alter the flight path. The alterations can include reducing and increasing the distance the projectile 20 travels. In addition, the projectile 20 can be maneuvered to the left and the right. A flight path of the projectile 20 as described is represented by line 54.

In the arrangement shown, the cannon 48 places a clockwise spin on the projectile 20 when looking from the rear of the projectile 20. The strakes 40, as shown in FIG. 1, place a counter-clockwise spin on the front section 34 of the guidance and control assembly 28 of the projectile 20 as the projectile 20 travels through the air.

Figure 3A:
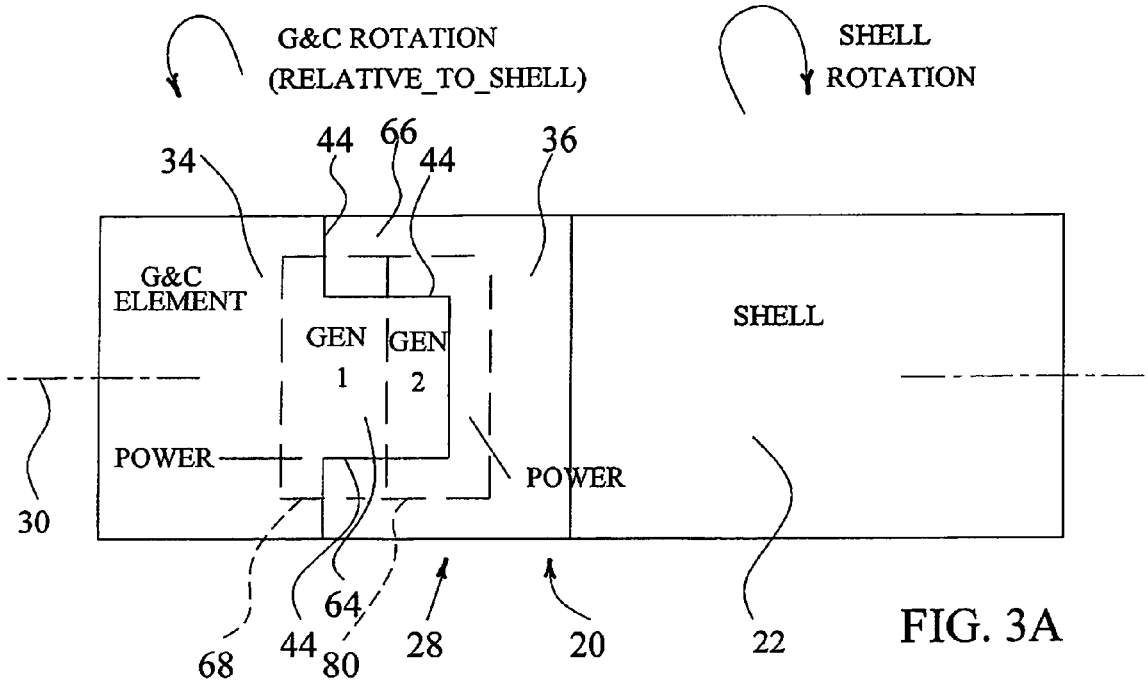
FIGS. 3A and 3B are schematic views of two alternative arrangements of the projectile.

Referring to FIG. 3A, a schematic arrangement of the projectile 20 is shown. The shell 22 is connected to the rear section 36 of the guidance and control assembly 28. The two sections 34 and 36 of the guidance and control assembly 28 are rotatably mounted to each other to allow relative rotation about the longitudinal axis 30 of the projectile 20. The interface between the two sections 34 and 36 is represented by a line 44 that projects towards the rear section 36 in the center portion near the longitudinal axis 30. The shell 22 and the rear section 36 rotate together and clockwise as the projectile 20 travels through the air. The front section 34 rotates counter-clockwise relative to the rear section 36 and the shell 22.

The projectile 20 has a pair of generators, a first or primary generator 68 and a second generator 80. Both generators have components in each section 34 and 36 of the guidance and control assembly 28. The generators 68 and 80 are represented by dashed line in FIG. 3A. In the arrangement shown in FIG. 3A, the primary generator 68 powers the front section 34 and the second generator 80 powers the rear section 36 and any components in the shell 26.

As the projectile 20 flies through the air, the clockwise rotation caused by the rifling in the cannon causes the projectile to rotate clockwise. The strakes 40 on the front section of the guidance and control assembly 28 as they pass through the air cause the front section 34 to rotate in the other direction, the counter-clockwise direction. The relative rotation between the two sections causes the relative components, the fields and armatures, of each the generators to move relative to each other and create a current.

The relative rotation of the front section 34 of the guidance and control assembly 28 can be controlled by the amount of energy siphoned off the primary generator, the first generator 68, tending to slow the prevailing front section counter spin. The generator 68 can be controlled to further reduce the counter spin by dissipating electrical power through the coils. In this way the front semi-static section can be controlled to be stationary relative to the earth while the rear section continues to rotate relative to the earth and maintain stability of the projectile 20 as it flies through the air.

This allows the front section 34 of the guidance and control assembly 28 to rotate relatively slowly or not at all relative to the underlying ground. This non-rotation or relative slow rotation results in more accurate position determination of the projectile 20 because of more accurate output by some of the sensors located in this section.

Figure 3B:
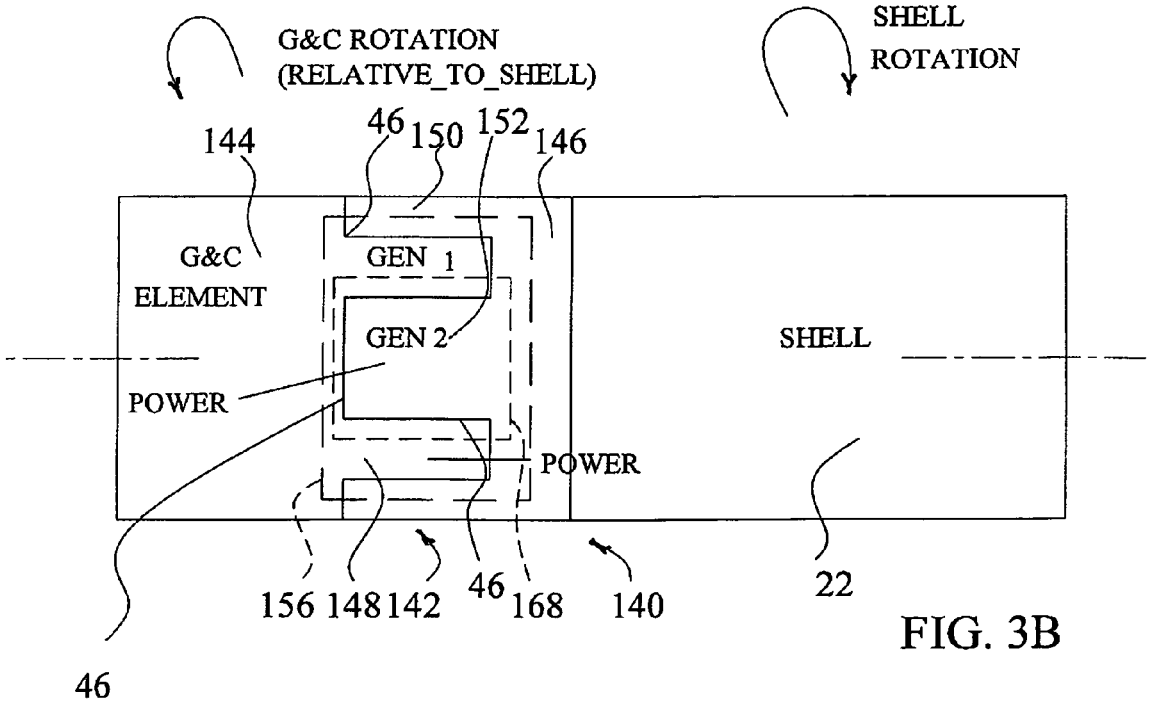

Referring to FIG. 3B, a schematic arrangement of an alternative projectile 140 is shown. The shell 22 is connected to the rear section 146 of the guidance and control assembly 140. The two sections 144 and 146 of the guidance and control assembly 140 are rotatably mounted to each other to allow relative rotation about the longitudinal axis 30 of the projectile 140. The interface between the two sections 144 and 146 is represented by a line 46 having a square wave shape. The shell 22 and the rear section 146 rotate together and clockwise as the projectile 140 travels through the air. The front section 144 rotates counter-clockwise rotation relative to the rear section 146 and the shell 22.

The projectile 20 has a pair of generators, a first or primary generator 156 and a second generator 168. Both generators have components in each section 144 and 146 of the guidance and control assembly 142. The generators 156 and 168 are represented by dashed line in FIG. 3B; the second generator 168 is located within the first generator 156. In the arrangement shown in FIG. 3B, the primary generator 156 powers the rear section 146 and the second generator 168 powers the front section 144.

Figure 4:
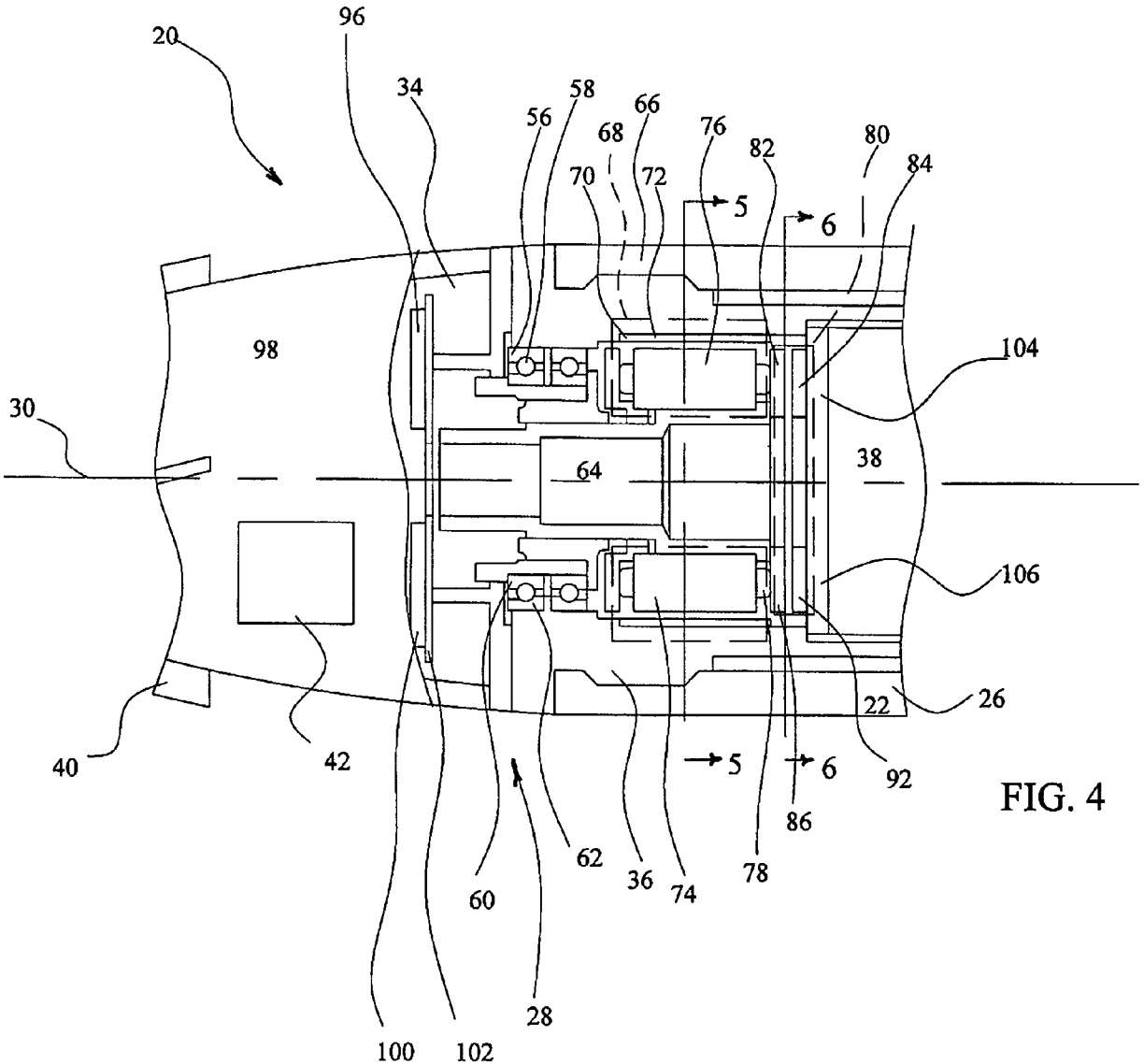
FIG. 4 is an enlarged section of a portion of the projectile.

Referring to FIG. 4, a portion of the projectile 20 is shown in section. The rear section 36 of the guidance and control assembly 28 is secured to the outer casing 22 of the shell 26. The front section 34 of the guidance and control assembly 28 is rotatably connected to the rear section 36 of the guidance and control assembly 28 by a pair of bearings 56. Each of the bearings 56 has a plurality of balls 58 interposed in between a pair of races 60 and 62. The inner race 60 is carried by the front section 34. The outer race 62 is carried by the rear section 36 of the guidance and control assembly 28. The bearings 56 allow relative rotation of the front and rear sections 34 and 36 of the guidance and control assembly 28 along the longitudinal axis 30.

The front section 34 of the guidance and control assembly 28 has a portion 64, to the right of the bearings 56 in FIG. 4, that is received within a fundamentally cylindrical section 66 of the rear section 36 of the guidance and control assembly 28. (i.e., a portion of the rear section of the guidance and control assembly encircles a co-axial portion 64 of the front section 34.)

Figure 5:
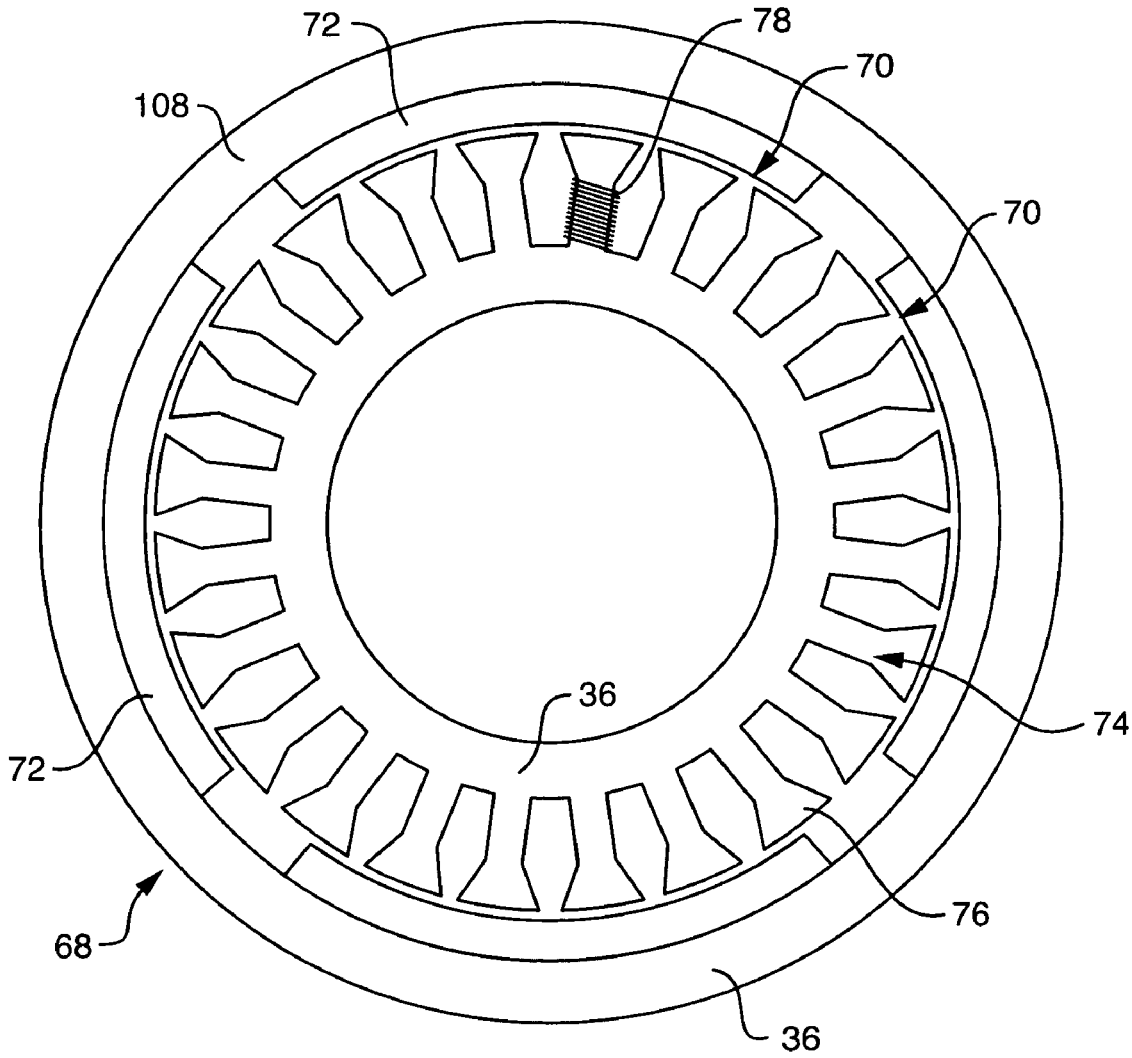
FIG. 5 is a cross section of the projectile taken along the line 5-5 in FIG. 4.

The guidance and control assembly 28 has a first generator 68 that is generally encircled by a pair of boxes in dashed line in FIG. 4. The generator 68 has a field 70 comprised of an array of magnets 72, as best seen in FIG. 5, mounted on the rear section 36 and an armature 74 carried by the front section 34. The armature 74 has a toothed laminated stack of steel rings 76 with magnet wire coils 78.

Figure 6:
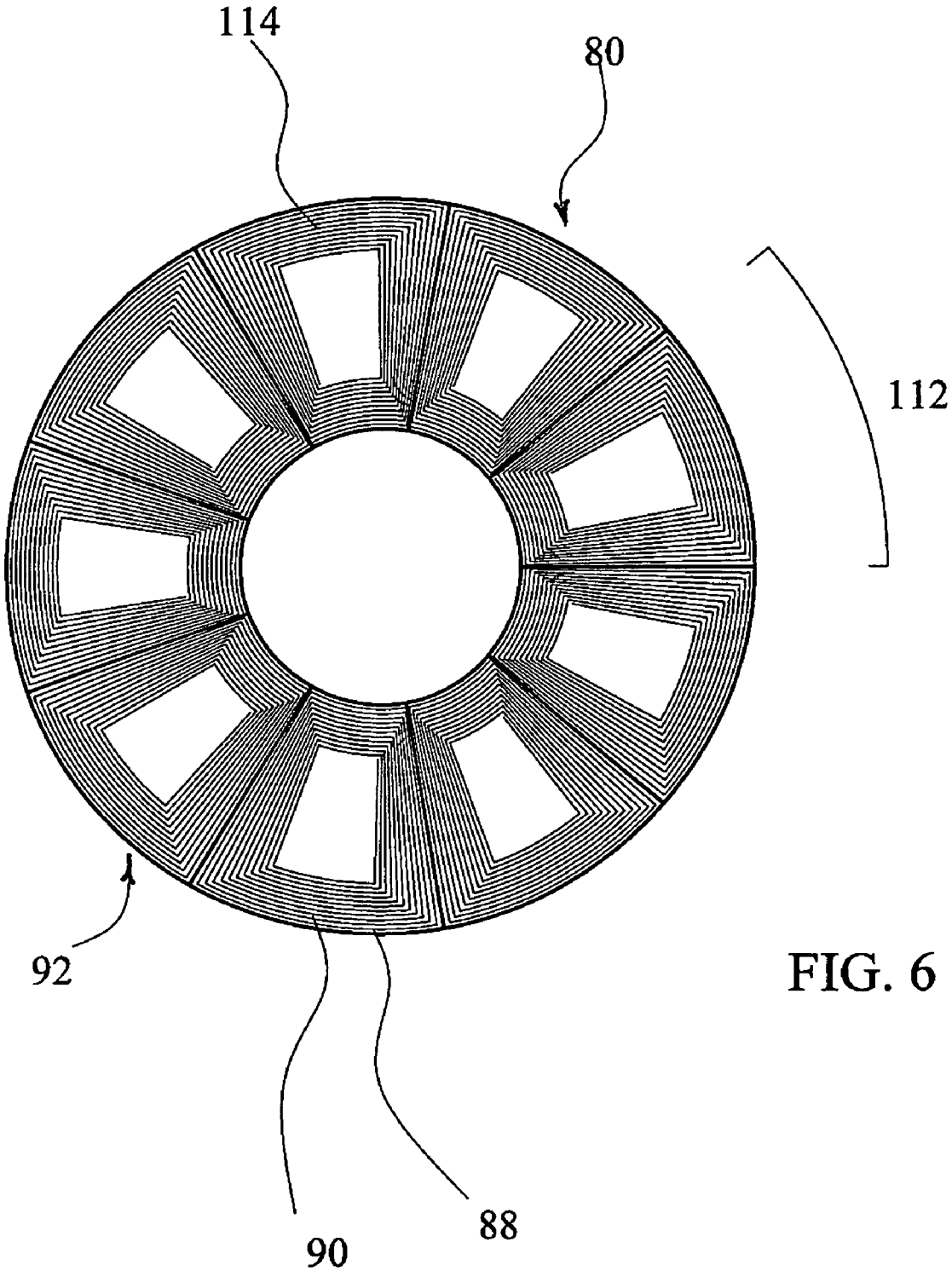
FIG. 6 is a cross section of the projectile taken along the line 6-6 in FIG. 4.

Still referring to FIG. 4, the guidance and control assembly 28 has a second generator 80 that is encircled by a box in dash line. The generator 80 has a pair of parallel planar boards 82 and 84, such as printed circuit boards. The first board 82 is the field 86 consisting of a plurality of alternating layers of conducting material 88 and insulating material 90, as seen in FIG. 6, and is mounted to the front section 34. The magnetic field results from current originating from the first generator 68 or from storage, as discussed with relation to FIG. 7, through some electronics. The second board 84, the armature 92, likewise consists of a plurality of alternating layers of conducting material 88 and insulating material 90, as best seen in FIG. 6 and is mounted to the rear section 36 of the guidance and control assembly 28. The armature 92 is magnetically linked to the field 86 so that as the magnetic flux changes, it generates an electrical potential in the armature 92—either as a function of relative motion between the field 86 and armature 92 or because current on the field 86 is varied, or a combination of both. The inductive gap, between the field 86 and the armature 92, of the second generator 80 is located in between the front section 34 and the rear section 36.

The relative rotation between the front section 34 and the rear section 36 of the guidance and control assembly 28 is the source of power in each generator 68 and 78.

The front section 34 has a controller 96 located in the nose 98 of the projectile 20. The controller 96 modulates the current from the first generator 68 to produce the correct amount of torque. In addition to the controller 96, the nose 98 of the front section 34 has other guidance and control electronics 100. In one arrangement, the controller 96 and the guidance and control electronics 100 are located on at least one printed circuit board 102.

A portion of three of the strakes 40, the aerodynamic device, are shown mounted to the exterior of the front section 34. In addition, the force-producing device 42 is shown in a pre-deployed position.

Still referring to FIG. 4, the rear section 36 in addition to the detonator 38 has additional components 104 including a safe and arm device 106.

FIG. 5 is a sectional view of the projectile 20 showing the first generator 68, also referred to as the primary generator. The generator 68 has the field 70 that is carried by the rear rotating section 36 of the guidance and control assembly 28. The field 70 consists of an array of alternating pole permanent magnets 72.

The armature 74 has the toothed lamination stack of steel rings 76 with magnet wire coils 78. The armature 74 is carried by and rotates with the front section 34. The relative motion between the field 70 and the armature 74 creates a changing magnetic flux, which produces a voltage in the coils 78.

In one arrangement, the rear rotating section 36 is formed of an outer steel ring 108. The alternating north-pole and south-pole magnets 72 are attached to the steel ring 108.

The generator 68 generates the requisite electrical power via the relative rotation of the field 70 and armature 74, corresponding to the relative rotation of the front section 34 and the rear section 36. In addition, the generator 68 can act as a braking mechanism to slow the relative rotation; the degree of braking depending on the amount of power pulled from the generator.

FIG. 6 shows the planar board 84 of the second generator 80 mounted to the rear section 36 of the guidance and control assembly 28. The planar board 84, a printed circuit board in the arrangement shown, has a number of alternating layers of conducting material 88 and insulating material 90 formed in a plurality of sectors 112. Each section or sector 112 contains a coil 114 formed of a continuous conductive trace of material 88. In contrast to the first generator 68 where the armature 74 is carried by the front section 34, the armature 92 of the second generator 80 is carried by the rear section 36.

Referring back to FIG. 4, in that the front section 34 and rear section 36 are rotating relative to each other, the additional components 104 located on the rear section 36 such as the detonator 38 and the safe and arm 106 cannot directly receive electrical power from the first generator 38. There can be no wires running from the front section 34 of the guidance and control assembly 28 to the rear section 36 of the guidance and control assembly 28 because of the continual high-speed relative motion between the two sections 34 and 36. Therefore the second generator 80 is used to generate electrical power needed for the additional components 104 that are located on the rear rotating section.

In one arrangement, the second generator 80 has two, parallel, printed circuit boards (PCB) 82 and 84 that are any common PCB thickness separated by a gap that is small in comparison to the length of the PCB. In a preferred embodiment, the PCBs each are approximately 0.060 inches thick, separated by a 0.020 inch gap. The first PCB can consist of a number of alternating layers of conducting and insulating material, typical of PCB construction. Each conducting layer is etched to form sectors 112; the sectors of one layer are serially connected with the coil on the next conducting layer through the thickness of the PCB to form one continuous coil through the entire thickness of the board. Each PCB has some number of etched electrical coils, for example the PCB shown in FIG. 6 has nine (9) sections or sectors 112.

Because of the relative size of the two generators 68 and 80, the first generator 68, the primary generator is used for controlling the relative rotation of the two sections 34 and 36 of the guidance and control assembly 28. The second generator 80 is used primarily for powering elements in the rear section 36 of the guidance and control assembly 28 and any elements located in the shell 26.

Figure 7:
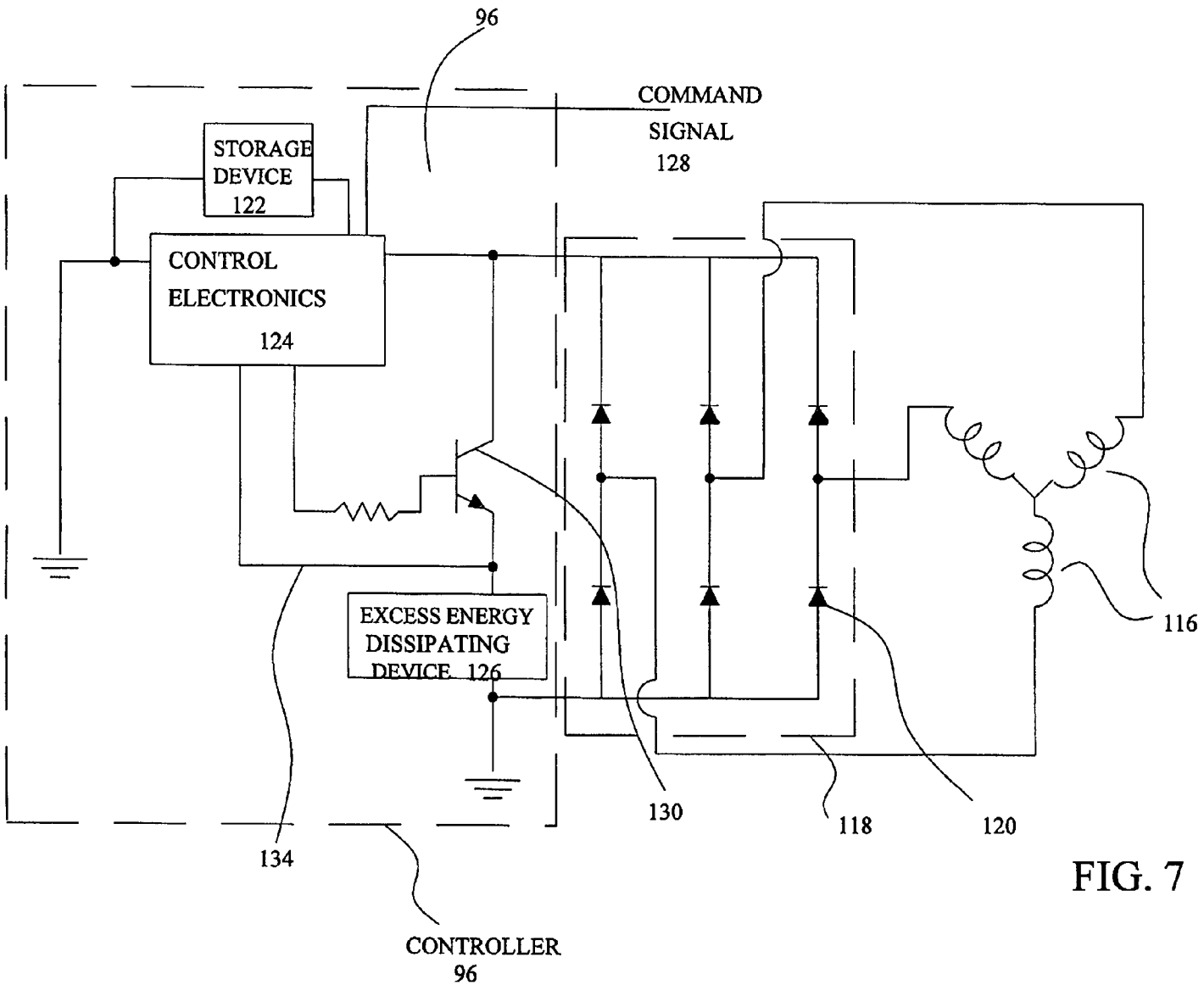
FIG. 7 is a block diagram of the control system and rectifier for a generator.

FIG. 7 is a block diagram of a generator, the first generator 68, a rectifier 118, and a controller 96. The generator 68 has a number of phases, three phases 116 as shown in this preferred embodiment, on the armature 74, as seen in FIG. 4, to collect the voltage produced in the coils 78 as the armature 74 creates a changing magnetic flux due to the relative rotations between the armature 74 and the field 70. In the arrangement shown, the generator 68 is a three-phase brushless DC type generator. The voltage from the three phases 116 are conditioned by a three-phase rectifier 118 having a plurality of diodes 120. The generator's alternating current is rectified by the rectifier 118 to direct current with little ripple.

The power from the generators 68 can supply all of the energy required. The electrical power is directed to a storage device 122 and control electronics 124 as required. The storage device 122 can be some combination of capacitors or rechargeable batteries. The stored energy can be used for intermittent power surge needs. The energy storage device 122 need only be large enough to supply those surges, and thus would be much smaller than storage devices capable of providing all system power for the entire projectile flight. A smaller storage device is advantageous because of the associated space requirement, weight requirements, and cost requirements. During much of the flight energy will be generated in excess of that required by the control electronics 124 and storage device 122. This excess energy can be dissipated by an excess energy dissipating device 126, such as through a resistor, to the surroundings, such as the casing 22 in the form of heat. The control electronics 124 receives a command signal 128 from other components 100 in the guidance and control assembly 28.

While only one block diagram is shown in FIG. 7, it is recognized that each generator 68 and 80 would have its own rectifier and controller.

In addition, the controller 96 for the generator includes a load-modulating device 130 to vary the load on the generator 68 which in turn varies the torque on the front section 34 to precisely control the counter spin. In one preferred embodiment the load-modulating device 130 is a power transistor, but it could be any number of power control or switching devices, such as relays, amplifiers, or a variety of transistors. The load-modulating device 130 is varied by the control electronics 124 having a feedback path 134 from the excessive energy dissipating device 126.

By varying the load, the counter spin of the front section 34 can be precisely controlled. While only one block diagram is shown in FIG. 7, it is recognized that each generator 68 and 80 would have its own rectifier and controller.

Figure 8:
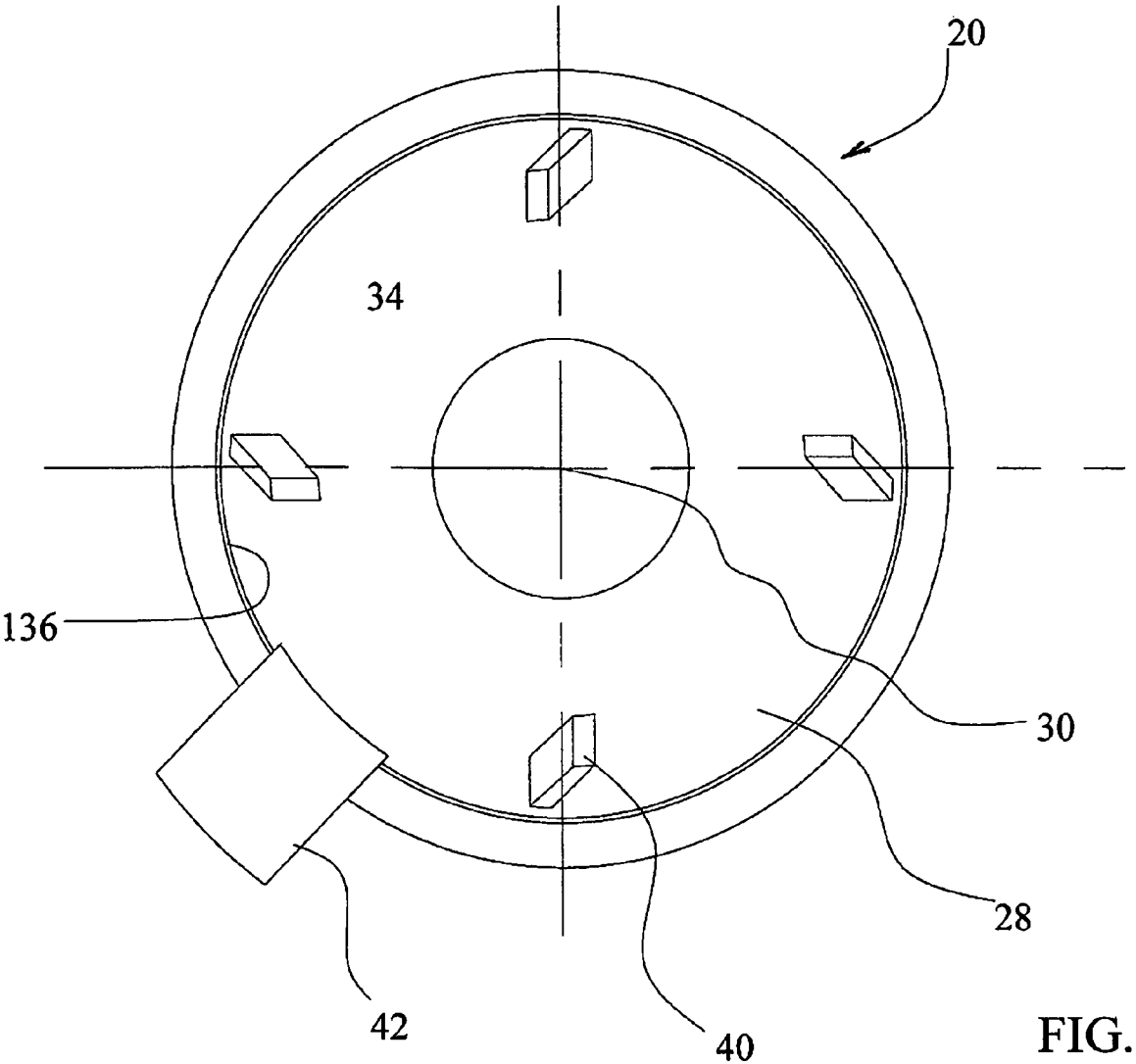
FIG. 8 is a front view of the projectile with a force producing device in a deployed position.

FIG. 8 is a front view of the projectile 20 with the force-producing device 42 in the deployed position. The four strakes 40 are located on the front section 34 of the guidance and control assembly 28. The front section 34/rear section 36 interface is represented by a circle 136. The force-producing device 42 in the arrangement shown is an air brake where the projectile 20 will deviate from the flight path in the direction of the force-producing device 42 due to aerodynamic drag resulting from the air brake.

When it is desired to deviate from the flight path in a particular direction such as shortening the flight path as seen in FIG. 2, the force-producing device 42 is moved by modulating the load-modulating device 130 such that the front section 34 rotates some fraction of a full rotation relative to the terrain/earth that the projectile 20 flies over. The force-producing device 42 located as it is in the lower left hand quadrant as shown in the FIG. 8 (a frontal view), which is the lower right hand quadrant looking from the rear of the projectile 20, will both alter the flight path downward and to the right as the projectile 20 flies through the air.

The guidance and control electronics 100, as seen in FIG. 4, located in the front section 34 are capable of tracking the performance and the position of the projectile 20 and supplying commands to the controller that will establish the correct trajectory. When the correct trajectory has been established, continued application of the force-producing device 42 in one direction would send the projectile 20, off-target in that the force-producing device 42 is a unidirectional force. Therefore, when the correct trajectory has been established, the first generator 68 will be modulated such that the control assembly 28 rotates relative to the earth at a small fraction of the projectile 20 spin rate.

If the sensors in the front section of the guidance and control assembly 28 detect that the projectile 20 is drifting from the correct path, such as from wind, the controller 96 of the guidance and control assembly 28 will modulate the first generator 68 to correctly position the front section 34 such that the front section is not spinning and the force-producing device is properly located to direct the projectile back on course. The constant readjusting of the front section 34 of the guidance and control assembly 28 is done by modulating (adjusting the current up and down, or switching the current on and off) the current of the first generator 68 by the controller 96. This modulation of the first generator 68 modulates the torque reacted in the generator in the manner established by the controller 96. When on, current is flowing, the generator produces a torque on the front section in the direction of the spin of the projectile and opposite that of the torque produced by the aerodynamic devices (i.e., the strakes 40).

The guidance portion of the projectile 20 is located in the front section of the guidance and control assembly 28. The detonator 38 and the safe and arm device 106 are located in the rear section 36. In order to communicate to the safe and arm device 106 and the detonator 38 located in the rear section 36, a high frequency signal is superimposed over the voltage developed by the relative rotation of the field 70 and the armature 74 of the second generator 80.

The siphoning off or scavenging of power from the first generator 68 for the electronics tends to slow the prevailing front section counter spin. The generator can be controlled to further reduce the counter spin by dissipating electrical power through the coils (either with or without an excessive energy dissipating device 126, such as a resistor). By this means the front semi-static section can be controlled to be stationary relative to earth while the rear section continues to spin.

Figure 9:
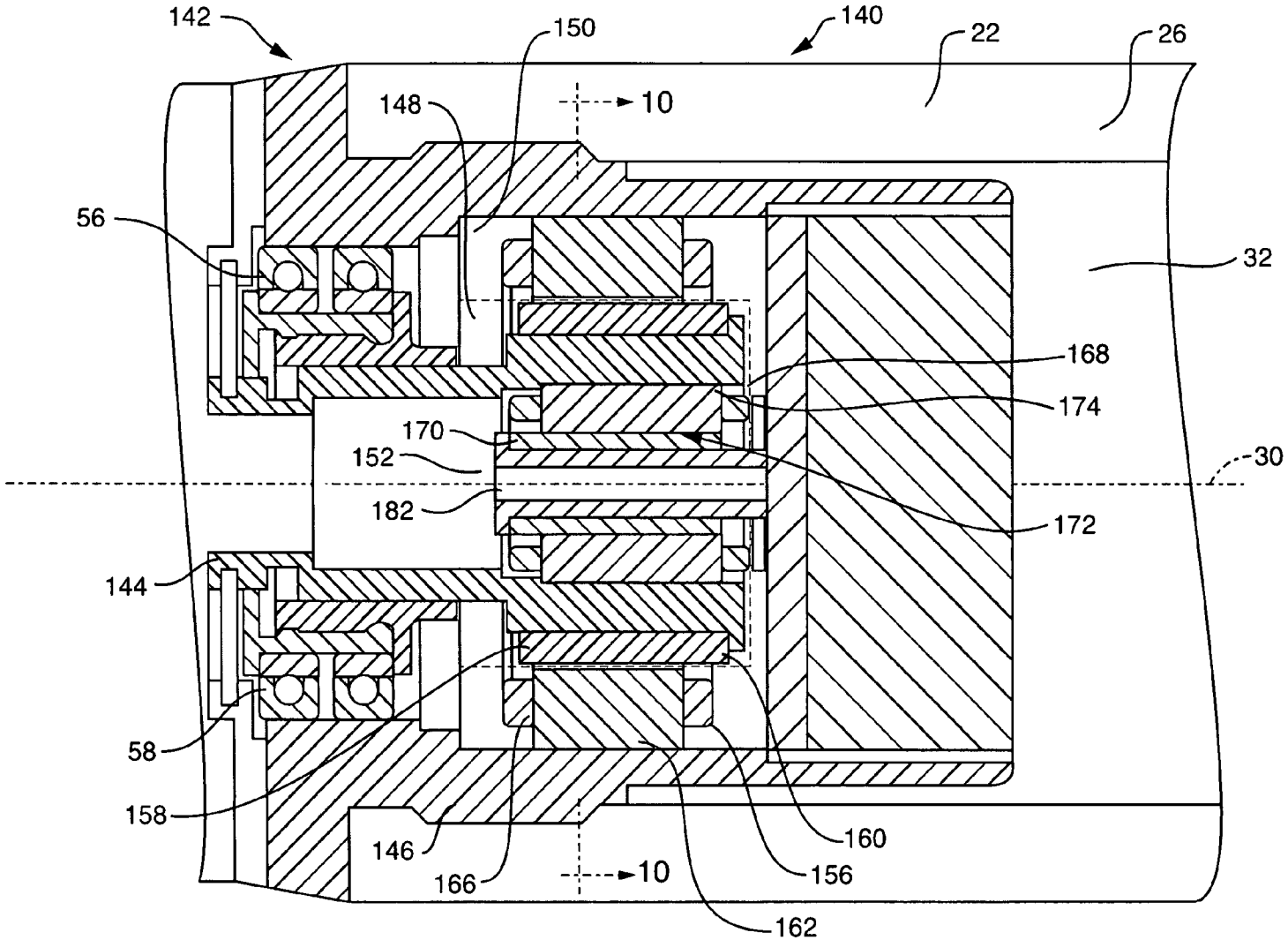
FIG. 9 is an enlarged section of a portion of an alternative arrangement of the projectile.

FIG. 9 shows an alternative arrangement of a projectile 140. The projectile 140, similar to the projectile 20 described above with respect to FIG. 1, has a shell 26 and a guidance and control assembly 142. The guidance and control assembly 142 is located in front, to the left in FIG. 9, of the shell 26 along the longitudinal axis 30 of the projectile 140. The shell 26 has an outer casing 22 and an explosive charge 32. The guidance and control assembly 142 has a front section 144 and a rear section 146. The front section 144 has a plurality of aerodynamic devices, such as the strakes 40 shown in FIGS. 1 and 7, and a force-producing device 42.

The two sections 144 and 146 of the guidance and control assembly 142 are rotatably mounted to each other to allow relative rotation about the longitudinal axis 30 of the projectile 140. The mechanically rotatable interface between the two sections 144 and 146 is a pair of bearings 56 as described above with respect to FIG. 4.

In contrast to the arrangement described above, the front section 144 of the guidance and control assembly 142 has an annular portion 148 that is received between an outer cylindrical section 150 of the rear section 146 of the guidance and control assembly 142 and central cylindrical portion 152 of the rear section 146.

Figure 10:
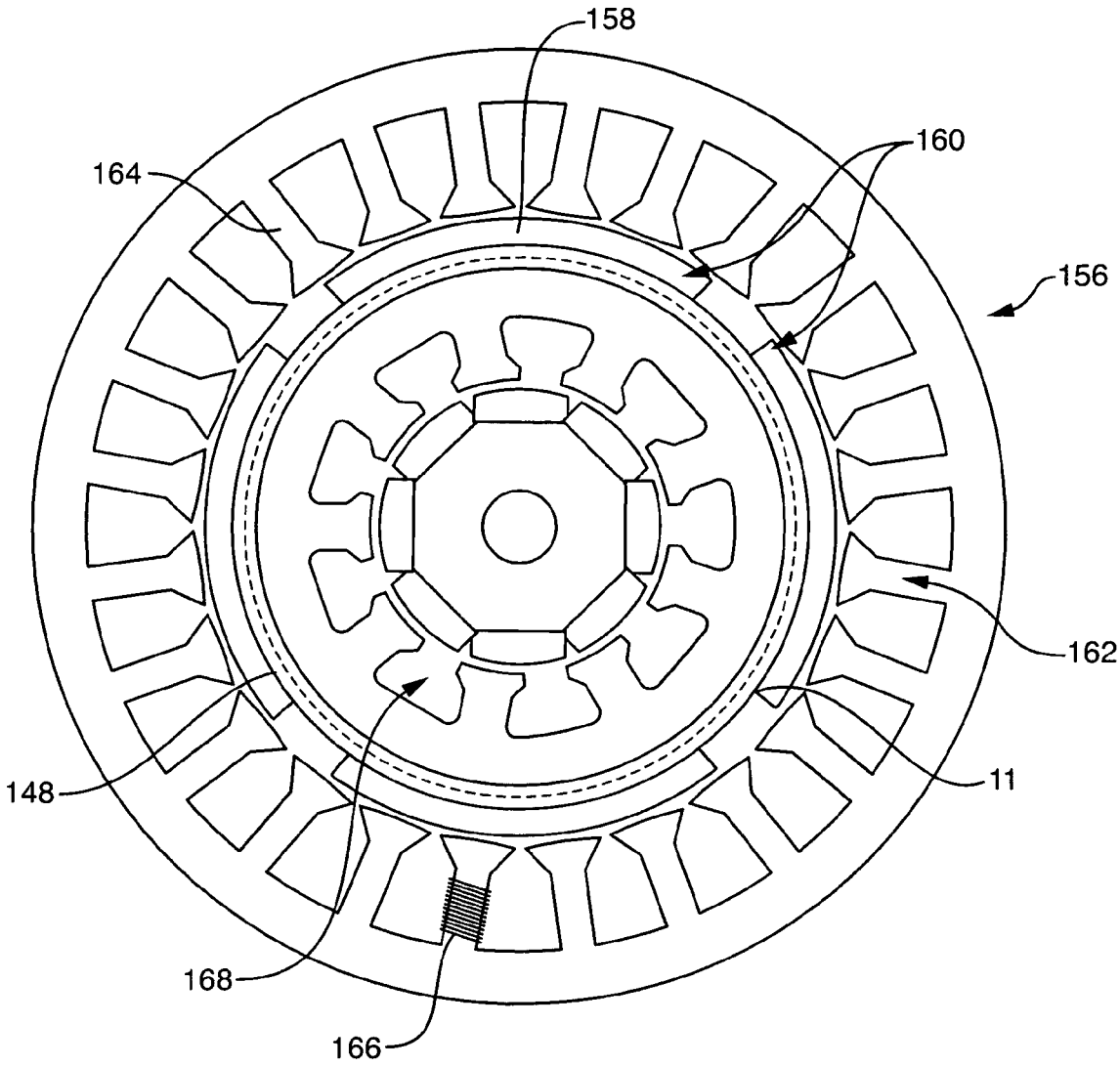
FIG. 10 is a cross section of the first generator of the projectile taken along the line 10-10 in FIG. 9.

Still referring to FIG. 9, the guidance and control assembly 142 has a first generator 156. The generator 156 has a field 158 having a series of magnets 160, as best seen in FIG. 10, mounted on the front section 144 and an armature 162 carried by the rear section 146. The armature 146 has a toothed laminated stack of steel rings 164 with magnet wire coils 166.

Figure 11:
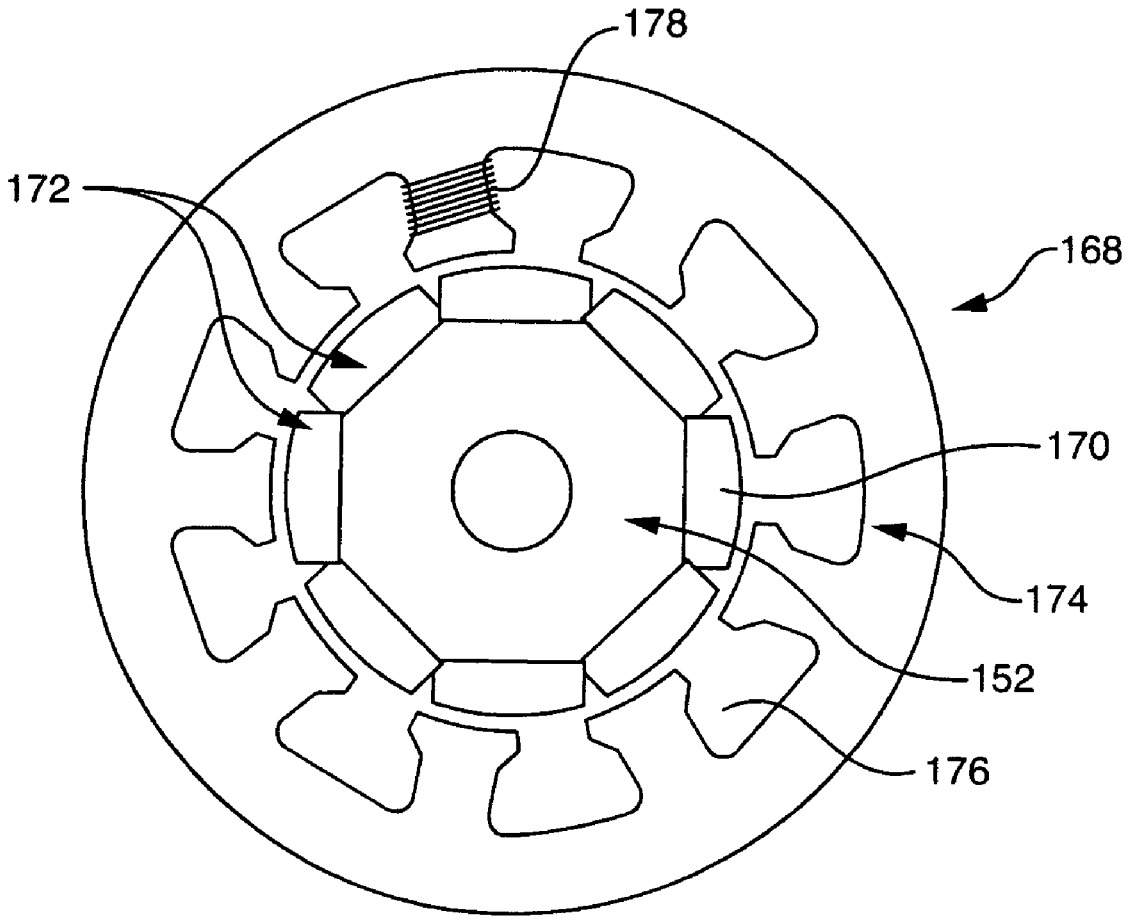
FIG. 11 is an enlarged cross section of the second generator of the projectile taken along the section 11 in FIG. 10.

In addition, the guidance and control assembly 142 has a second generator 168 which is co-axial about the longitudinal axis 30 with the first generator 156. The second generator 168 has a field 170 having a series of magnets 172, as best seen in FIG. 11, mounted on the rear section 146 and an armature 174 carried by the front section 144. The armature has a toothed laminated stack of steel rings 176 with magnet wire coils 178.

FIG. 10 is a sectional view of the projectile 140 showing the first generator 156, also referred to as the primary generator. The generator 156 has the field 158 that is carried by the front rotating section 144 of the guidance and control assembly 142. The field 158 has alternating pole magnets 160.

The armature 162 has the toothed laminated stack of steel rings 164 with magnet wire coils 166, as best seen in FIG. 9. The armature 162 is carried by and rotates with the rear section 146. The relative motion between the field 158 and the armature 162 creates a changing magnetic flux, which produces a voltage in the coils 166.

In one arrangement, the generator 156 is a three-phase brushless DC type and its control circuitry is preferably composed of a three-phase rectifier 118 with a load-modulating device 130 (likely a transistor) to modulate the rectifier output. The control circuitry has been described above with respect to FIG. 7.

The second generator 168 is co-axial about the longitudinal axis 30 with the first generator 168 and located within the cylindrical space that the magnets 160 of the field 158 of the first generator 168 encircle as shown in FIG. 10. FIG. 11 is a sectional view of the projectile 140 showing the second generator 168. The generator 168 has the field 170 that is carried by the rear rotating section 146 of the guidance and control assembly 142. The field 170 has alternating pole magnets 172.

The armature 174 has the toothed laminated stack of steel rings 176 with magnet wire coils 178, as best seen in FIG. 11. The armature 174 is carried by and rotates with the front section 144. The relative motion between the field 170 and the armature 174 creates a changing magnetic flux, which produces a voltage in the coils 178.

In an arrangement, the armature and field are typically of brushless DC machine design. This generator 168 supplies energy to the components located in the front section. As in the first arrangement described with respect to the first generator 68, the excess energy can be stored in the storage device 122. Energy from the storage device 122 could be used for intermittent power surge needs.

In contrast to the armature 92 being mounted on the front section 34 and the field 70 being mounted on the rear section 36 as in the arrangement described above with respect to FIGS. 4-6, the armature 162 is mounted on the rear section 146 and the field 158 is mounted on the front section 144. With this alternative arrangement, the power from this first generator 156 supplies the rear section 146 of the guidance and control assembly 142 and any power requirements of the shell.

The rear section 146 of the guidance and control assembly 142 has safe and arm controls, and a detonator 38 which detonates the explosive charge 32 in the projectile 140 when activated.

Referring back to FIG. 9, electronics such as the controller in the front section 144 and the safe and arm in the rear section 146 communicate by sending signals via an optical link 182 through a hole along the centerline of the longitudinal axis 30, from the front section 144 to the rear section 146. Optical transmitter-receivers are positioned at each end of the hole, one in the front section 144 associated with the guidance and control and one in the rear associated with the safe and arm. The electronic components receiving power from the first generator 156 are located in the rear section 146 and are controlled by a circuit such as shown in FIG. 7.

The second generator 168 is used to power the controller electronics, and other components located in the front section 144. While the second generator 168 powers electronics in the front section 144, the first generator 156, like in the first arrangement, is used to control the relative rotation of the front section 144 and the rear section 146 and the direction of travel of the projectile 140.

While this invention has been particularly shown and described with references to preferred embodiments thereof, it will be understood by those skilled in the art that various changes in form and details may be made therein without departing from the spirit and scope of the invention as defined by the appended claims.

For example, it is recognized that the force-producing device can be reconfigured into a non-unidirectional force-producing configuration, or it can be jettisoned after the correct trajectory has been established. It is also recognized that the force-producing device can be a device that creates some type of lift or thrust in contrast to drag. Force-producing lift devices can include fixed canards, an asymmetric nose and strakes that are angled to give both spin moment and side force. Force-producing thrust devices include either a hot or cold gas impulse jet.

It is recognized that the projectile can have sensors and guidance systems that predict, based on flight path response to environmental conditions such as wind, that it is likely that the projectile will need an allotted margin in the predicted trajectory that might be needed as the projectile approaches the target. In that the projectile does not have propulsion system to forcibly extend the flight, the system can purposely follow an overshoot trajectory—thus avoiding undershooting the target—allowing for end-of-mission corrections to accurately complete the flight to the target. In addition, the sensors and guidance system may determine that compensation is required to the sensitivity of the system controls in that the projectile's flight path is being either overcorrected or under corrected when compared to that which is expected. These corrections to avoid undershoot and to compensate control sensitivity may be done in combination with other corrections in the flight path.

It is recognized that while a three-phase brushless DC type generator is described, that other types of generators can be used such as an AC type generator, a brushed type DC generator, or compound wound generator, and that a brushless DC type generator with any number of phases can be used in conjunction with a rectifier with the same number for phases.

It is recognized that an alternate configuration of FIG. 6 could be a trace of simple spiraling concentric rings, creating one coil in the field and one coil in the armature for a single-phase transformer arrangement. In this case relative motion would not vary the flux. While the generators are shown with 3 phases, it is recognized that there could be have some other number of phases, such as 1 or 4.

It is recognized that this invention can be used with various types of projectiles and missiles. While a cannon-fired projectile is described above, it is recognized that the invention can be implemented in whole or in part with other devices such as a rocket propelled missile, a mortar, a rail-gun launched projectile, or a guided bomb.

What is claimed is:

1. A projectile comprising:

a shell having a charge;

a guidance and control assembly, having a front section and a rear section, the sections rotatably mounted to each other;

the rear section of the guidance and control assembly secured to the shell;

the front section of the guidance and control assembly having an aerodynamic device for influencing the relative rotation of the front section of the guidance and control assembly relative to the rear section and the shell;

a first generator having an armature and a field, the field carried by one of the sections of the guidance and control assembly and the armature carried by the other section;

a second generator having an armature and a field, the field carried by the section carrying the armature of the first generator and the armature carried by the section carrying the field of the first generator; and one of the generators scavenging power from relative rotation of the front and rear sections to power at least one electrical component located in the front section of the guidance and control assembly, the other generator scavenging power to power at least one electrical component located in the rear section of the guidance and control assembly and in the shell.

2. A projectile of claim 1 wherein the armature of the first generator is carried by the front section of the guidance and control assembly and the field of the first generator is carried by the rear section of the guidance and control assembly;

the armature of the second generator is carried by the rear section of the guidance and control assembly and the field is carried by the front section of the guidance and control assembly; and the first generator scavenges power from relative rotation to power at least one component located in the front section of the guidance and control assembly, the second generator scavenges power to power at least one component located in the rear section of the guidance and control assembly and in the shell.

3. A projectile of claim 2 wherein the field of the first generator produced by an array of permanent magnets and the field of the second generator produced by an electromagnet magnet produced by a current originating from the first generator.

4. A projectile of claim 2 wherein the armature and the field of the second generator each having a planar surface with a plurality of arc sections, each section having a series of conductive traces formed into a spiral pattern forming a segment winding.

5. A projectile of claim 2 wherein a signal is communicated from the front section of the guidance and control assembly to the rear section of the guidance and control assembly through an armature field interface of the second generator by a high frequency signal.

6. A projectile of claim 1 wherein the armature of the first generator carried by the rear section of the guidance and control assembly and the field of the first generator carried by the front section of the guidance and control assembly;

the armature of the second generator carried by the front section of the guidance and control assembly and the field carried by the rear section of the guidance and control assembly; and the first generator scavenging power from relative rotation to power at least one component located in the rear section of the guidance and control assembly and the shell and the second generator scavenging power to power at least one component located in the front section of the guidance and control assembly.

7. A projectile of claim 1 wherein one of the generators reduces rotation of the front section relative to the rear section by drawing current from the armature.

8. A projectile of claim 7 wherein the one of the generators reduces the relative rotation of the front section to the rear section by electromagnetic braking.

9. A projectile of claim 1 wherein the front section's rotary position relative to the rear section of the guidance and control assembly and the shell is controlled by a controller varying the current drawn from one of the generators.

10. A projectile of claim 9 further comprising a force-producing device for exerting a force substantially perpendicular to a longitudinal axis of the projectile, the force-producing device carried by the front section of the guidance and control assembly.

11. A projectile of claim 9 wherein the aerodynamic device is a plurality of strakes for inducing a relative rotation of the front section counter to the rotation of the rear section.

12. A projectile comprising:

a shell having a charge;

a guidance and control assembly, having a front section and a rear section, the sections rotatably mounted to each other;

the rear section of the guidance and control assembly secured to the shell and having a detonator;

the front section of the guidance and control assembly having an aerodynamic device for influencing the relative rotation of the front section of the guidance and control assembly relative to the rear section and the shell;

a generator having an armature and a field, the field carried by one of the sections of the guidance and control assembly and the armature carried by the other section, the generator scavenging power from the relative rotation to power at least one component; and a force-producing device for exerting a force substantially perpendicular to the longitudinal axis of the projectile to alter the path of the projectile.

13. A projectile of claim 12 further comprising a second generator having an armature and a field, the field carried by the section carrying the armature of the first generator and the armature carried by the section carrying the field of the first generator; and one of the generators scavenging power from relative rotation to power at least one component located in the front section of the guidance and control assembly, the other generator scavenging power to power at least one component located in the rear section of the guidance and control assembly and the shell.

14. A projectile of claim 13 wherein the armature of the first generator is carried by the rear section and the field of the first generator is carried by the front section of the guidance and control assembly;

the armature of the second generator is carried by the front section of the guidance and control assembly and the field is carried by the rear section of the guidance and control assembly; and the first generator scavenging power from relative rotation to power at least one component located in the rear section of the guidance and control assembly and the shell and the second generator scavenging power to power at least one component located in the front section of the guidance and control assembly.

15. A projectile of claim 13 further comprising a communication linking mechanism for communication between components in the front section with components in the rear section and in the shell.

16. A projectile of claim 15 wherein the communication linking mechanism is an optical link.

17. A projectile of claim 15 wherein the communication linking mechanism is a high frequency signal carried over a field/armature interface.

18. A projectile of claim 13 wherein the first and the second generators are co-axial.

19. A projectile of claim 18 wherein the aerodynamic device is a plurality of strakes for inducing a relative rotation of the front section counter to the rotation of the rear section and the force-producing device is an asymmetric deployable air brake.

20. A projectile of claim 12 further comprising a controller that directs energy from the generator to alternative devices including a recharge storage device and an excess energy dissipating device.

21. A projectile of claim 12 further comprising a controller for the generator responses to commands to vary the current resulting in varying the torque, to achieve the proper orientation of the force-producing device.

22. A method of targeting a projectile, the method comprising the steps of:

firing the projectile from a gun;

creating a rotation of the projectile along a longitudinal axis of the projectile due to the rifling of the barrel of the gun;

rotating a front section of the guidance and control assembly of the projectile relative to a rear section of the guidance and control assembly and a shell of the projectile by a plurality of aerodynamic devices carried by the front section interacting with the air as the projectile moves through the air;

creating power in the projectile by having a pair of generators in the guidance and control assembly wherein each generator has a field and armature and the field of one of the generators and the armature of the other generator is carried by the front section and the armature of the one of the generators and the field of the other generator is carried by the rear section; and powering at least one component in each of the sections of the guidance and control assembly with power from the respective generator.

23. A method of targeting a projectile of claim 22 further comprising the steps of:

deploying a force-producing device carried by the front section;

positioning the force-producing device by rotating the front section by controlling the power requirements of one of the generators;

monitoring the position and the trajectory of the projectile relative to a target by a sensor carried in the front section; and repositioning the force-producing device as necessary to maneuver the projectile towards the target.

* * * * *